US009359048B2

(12) United States Patent
Keuning

(10) Patent No.: US 9,359,048 B2
(45) Date of Patent: Jun. 7, 2016

(54) FAST SHIP

(71) Applicant: Technische Universiteit Delft, Delft (NL)

(72) Inventor: Jan Alexander Keuning, Willemstad (NL)

(73) Assignee: Technische Universiteit Delft, Delft (NL)

( * ) Notice: Subject to any disclaimer, the term of this patent is extended or adjusted under 35 U.S.C. 154(b) by 0 days.

(21) Appl. No.: 14/761,175

(22) PCT Filed: Jan. 17, 2014

(86) PCT No.: PCT/EP2014/050862
§ 371 (c)(1),
(2) Date: Jul. 15, 2015

(87) PCT Pub. No.: WO2014/111497
PCT Pub. Date: Jul. 24, 2014

(65) Prior Publication Data

US 2015/0336643 A1 Nov. 26, 2015

(30) Foreign Application Priority Data

Jan. 18, 2013 (EP) ..... 13151934

(51) Int. Cl.
*B63B 43/06* (2006.01)
*B63B 3/44* (2006.01)
(Continued)

(52) U.S. Cl.
CPC . *B63B 43/06* (2013.01); *B63B 1/18* (2013.01); *B63B 1/30* (2013.01); *B63B 3/44* (2013.01);
(Continued)

(58) Field of Classification Search
CPC ..... B63B 43/06
USPC ..... 114/284, 125
See application file for complete search history.

(56) References Cited

U.S. PATENT DOCUMENTS 3,085,535 A * 4/1963 Hunt ..... B63B 1/18 114/125
4,217,845 A * 8/1980 Hood ..... B63B 43/06 114/125

(Continued)

FOREIGN PATENT DOCUMENTS

| | | | |
|---|---|---|---|
| EP | 0466382 | A1 | 1/1992 |
| FR | 2775948 | A1 | 9/1999 |
| JP | 6029393 | A | 2/1985 |

OTHER PUBLICATIONS

Grigoropoulos, Gregory J., and Dimitris S. Chalkias. "Hull-form optimization in calm and rough water." Computer-Aided Design 42 (2010): 977-984.

(Continued)

*Primary Examiner* — Lars A Olson
*Assistant Examiner* — Jovon Hayes
(74) *Attorney, Agent, or Firm* — St. Onge Steward Johnston and Reens, LLC

(57) ABSTRACT

A ship whereby the hull and the mechanical propulsion device are designed such that the Froude number is larger than 0.5. In the aft ship the hull has a bottom with V-shaped bottom surfaces with a deadrise angle that is less than 40 degrees and the hull has substantially vertical sides. In the hull are a passenger compartment and a trim tank. The trim tank volume is such that the weight of a filled trim tank is more than 30% of the weight of displacement of the hull with an empty trim tank, filling the trim tank with water increases the amidships immersed width with at least 10%, and the bottom surfaces have bilge keels fully immersed when the trim tank is filled with water and the bilge keels are at least in part above the water level when the trim tank is empty.

16 Claims, 3 Drawing Sheets

(51) Int. Cl.

| | |
|---|---|
| ***B63B 1/18*** | (2006.01) |
| ***B63B 1/30*** | (2006.01) |
| ***B63B 35/00*** | (2006.01) |
| ***B63J 2/04*** | (2006.01) |
| ***B63B 38/00*** | (2006.01) |
| *B63B 1/06* | (2006.01) |
| *B63B 3/38* | (2006.01) |
| *B63B 39/06* | (2006.01) |
| *B63B 43/04* | (2006.01) |

(52) U.S. Cl.

CPC ..... *B63B 35/00* (2013.01); *B63B 38/00* (2013.01); *B63J 2/04* (2013.01); *B63B 2001/066* (2013.01); *B63B 2003/385* (2013.01); *B63B 2035/004* (2013.01); *B63B 2039/067* (2013.01); *B63B 2043/047* (2013.01)

(56) References Cited

U.S. PATENT DOCUMENTS

| | | | | |
|---|---|---|---|---|
| 5,325,804 | A * | 7/1994 | Schneider | B63B 1/107 114/125 |
| 5,645,003 | A * | 7/1997 | Grinde | B63B 1/042 114/125 |
| 6,325,009 | B1 * | 12/2001 | Schulz | B63B 1/042 114/138 |
| 2015/0336643 | A1 * | 11/2015 | Keuning | B63B 38/00 114/284 |

OTHER PUBLICATIONS

International Search Report and Written Opinion Application No. EP 2014 050862 Completed Feb. 21, 2014; Mailing Date: Mar. 3, 2014 12 Pages.

* cited by examiner

FAST SHIP

FIELD OF THE INVENTION

The field of the invention is ships with hull designs and mechanical propulsion devices that help stabilize the ship during travel especially when transporting passengers.

BACKGROUND OF THE INVENTION

Some ships are used to transport people on the high seas. Such ships are well known for use at high speeds in order to transport people in a passenger compartment to and from an object located at high seas. For use of such ships the behavior of the ship while at sea is important as the passengers are not always accustomed to conditions at sea. While moving at high speed over the waves the water flow along the bottom surfaces stabilizes the roll movement of the ship. After the ship reduces its speed to near zero and/or keeps a stationary position near the object this stabilizing influence disappears, wave induced movements of the ship such as roll movements and/or pitch movements of the hull increase and these movements strongly reduce the comfort for the passengers. Also the transfer of passengers between the ship and the object is hampered even if a special stabilized transfer-gangway is used.

SUMMARY OF THE INVENTION

These disadvantages of the instability of passenger ships is reduced in the ship embodying the invention. According to the invention the ship with a filled trim tank has an increased beam and an increased inertia so that the natural frequency for rolling is lower. This makes the ship more comfortable for the passengers at low speeds near the object. During sailing the trim tank is emptied and the ship can plane over the waves at high speed.

Also, when the trim tank is filled and the ship has almost zero speed or is stationary, the bilge keels reduce the roll movement of the ship due to incoming waves. When the trim tank is empty during high speed operation the bilge keels hardly influence the ships resistance or speed, but contribute to planing of the ship and improve the stability of the ship during planing.

In one embodiment the ship has bilge keels that are retractable. In this way, during sailing at lower speeds the resistance of the hull is reduced and during mooring damage to the bilge keels is avoided.

In another embodiment the ship has a trim tank filled with water and the bilge keels (13, 26) extend to a draught (18) of more than 0.50 m or more than 4% of the immersed width or beam, whichever is less. In this way, the bilge keels are at sufficient depth below the water level to have their full effect and they strongly reduce the rolling movement of the hull.

In another embodiment the ship has bilge keels that extend perpendicular to the bottom surfaces with a bilge keel height (16) of more than 0.50 m or more than 4% of the width or beam at water level, whichever is less. In this way, the bilge keels have a strong influence on the rolling movement.

In another embodiment of the ship the downwards directed angle between the bilge keel and the bottom surface there is a rounded transition with a radius (14) that might be at least 50% of the bilge keel height (16) and wherein the bilge keels might be located such that with an empty trim tank and with a forward moving ship the bottom surfaces and the bilge keels create a downwards directed spray. In this way, at high speeds of the ship the bilge keels act as a spray strip deflecting the waves flowing along the bottom surface downwards. This reduces the spray caused by the ship and stabilizes the ship on the water.

In another embodiment the ship has bilge keels that extend on each side of the hull over a length of more than 30% of the overall length. In this way, the bilge keels are active over a considerable length of the hull and have a strong diminishing influence on the rolling movement of the ship.

In another embodiment the ship has bilge keels that extend on each side of the hull over a length of approximately 60% of the overall length. In this way, the bilge keels are active over a major part of the length of the hull so that the influence of the bilge keels is strong to reduce the roll movement of the ship.

In another embodiment the ship has bilge keels that extend from the aft ship, preferably from the stern, towards the foreship. In this way, the bilge keels are active over of the widest part of the hull so that the influence of the bilge keels is very strong to reduce the roll movement of the ship.

In another embodiment of the ship the trim tank might comprise one or more compartments that is located amidships above the center of gravity of the hull or amidships at the sides of the ship. In this way, the mass of the fluid in the trim tanks slightly increases the height of the center of gravity of the hull that floats deeper in the water. This reduces the natural frequency of the roll movement of the hull and improves the comfort of passengers of the ship when the trim tanks are filled.

In another embodiment of the ship the trim tank comprises two compartments and one trim tank compartment is located in the foreship near the bow and one trim tank compartment is located near the stern. In this way, filling the trim tanks increases the moment of inertia for pitching oscillations which causes a lower natural frequency for pitching of the hull which is more comfortable.

In another embodiment of the ship the trim tank is located at approximately or near the water level or wherein the trim tank is located above the main deck. In this way, the mass in the trim tank increases the height of the center of gravity and reduces the metacentric height, which is the distance between the centre of gravity and the metacentre for the oscillating roll and/or pitch movement. This further reduces the natural frequency of the roll and/or pitch movements of the hull which improves the comfort of the passengers.

In another embodiment of the ship the passenger compartment is near the center of gravity of the hull and the passenger compartment is acoustically isolated and/or might have an air conditioning system. In this way, the comfort of the passenger improves also during the trip to the object and seasickness is avoided.

In another embodiment of the ship the passenger compartment comprises passenger seats that have backrests that are reclinable to a substantially horizontal position and wherein there might be such passenger seats for all passengers. In this way, the passengers can rest in a horizontal position during sailing and the risk of seasickness is further reduced.

In another embodiment of the ship the passenger compartment includes a visual display and/or a window showing the horizon. In this way, the risk of seasickness is further reduced.

BRIEF DESCRIPTION OF THE DRAWINGS

The invention will be explained in more detail below with reference to several exemplary embodiments by means of a drawing, in which.

DETAILED DESCRIPTION OF THE INVENTION

Figure 1:
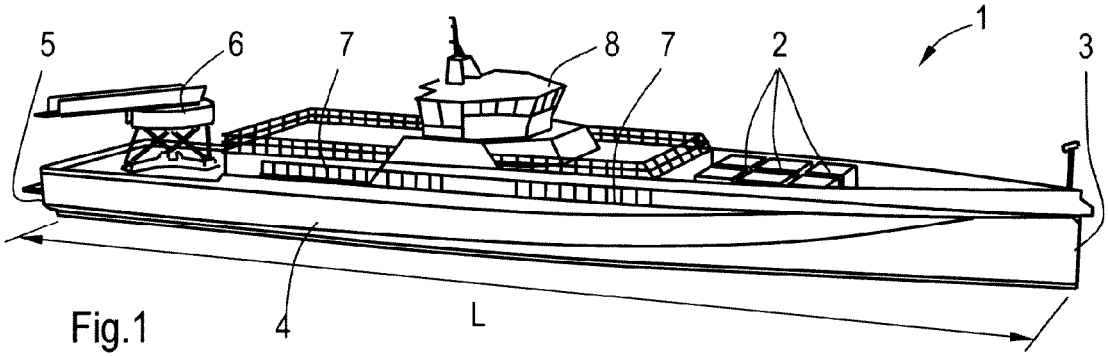
FIG. 1 shows a perspective view of a first embodiment of the fast ship according to the invention.
Figure 2:
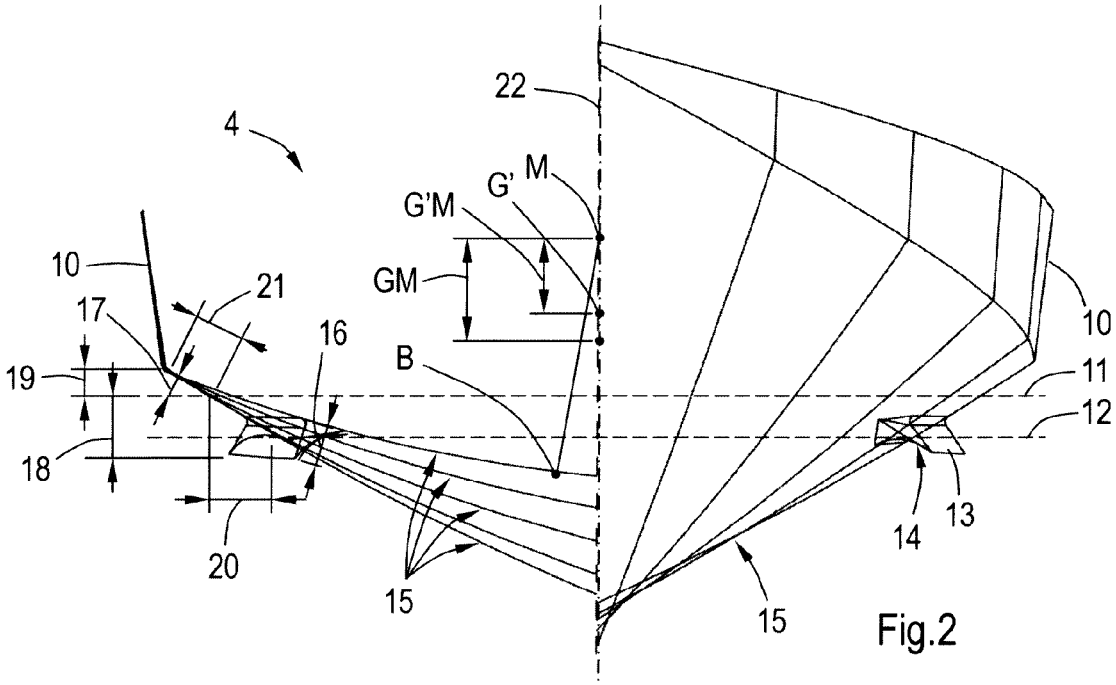
FIG. 2 shows a body plan of the ship of FIG. 1.

FIG. 1 shows a ship 1 with a hull 4 that has a bow 3 and a stern 5. On the waterline the hull has a length L. In the shown embodiment the length of the waterline is 70 meter and is approximately equal to the overall length; the width W (not shown) is approximately 14 meter. The ship 1 has a mechanical propulsion (not shown) for obtaining a maximum speed v (m/sec), in the shown embodiment approximately 32 knots. As is shown in FIG. 2 in the lines plan, the hull 4 is designed for planing over the water and the hull 4 is designed such that a Froude number of more than 0.5 is reached and preferably more than 0.6. The Froude number is equal to the maximum speed v divided by the square root of the product of the waterline length L and the gravitational constant g ($v/\sqrt{g*L}$). By taking into account the Froude number of at least 0.5 and possibly at least 0.6, other embodiments of ships according to the invention can be designed for all waterline lengths.

The ship 1 according to FIG. 1 is designed for transporting passengers in a passenger compartment 7. In this embodiment the passenger compartment 7 is designed for a maximum of 70 passengers. The passenger compartment 7 is designed for reducing seasickness of the passengers. This means that the passenger compartment 7 is located near the centre of gravity of the ship which is amidships. A further feature is that the passenger compartment 7 is sound isolated and that is has an air conditioning system to provide maximum comfort and is well lighted. As shown in FIG. 1 the passenger compartment 7 has many windows so that the passengers can view the horizon. In locations of the passenger compartment 7 where there is insufficient view of the horizon there are visual displays that show the horizon. It will be clear that in other embodiments the passenger compartment 7 can be located in other positions and can have other facilities.

An important feature for increasing the comfort of the passengers and to increase their ability to avoid seasickness are seats mounted on the deck that have mechanically or electrically adjustable lumbar supports. For full benefit, the adjustment of the back rest of the seat is to the horizontal position so that the passengers, and possibly all passengers, can comfortably rest horizontal during their trip over sea. For transporting a limited amount of cargo the ship 1 has cargo holds 2 and amidships there is a wheelhouse 8. It will be clear that the ship 1 includes all equipment that is required on such ships, such as propulsion and steering means, fuel tanks, ballast tanks, navigation equipment etc.

At the rear of the ship 1 near the stern 5 is a gangway 6 with a self stabilizing platform that follows the movements of the ship 1 relative to a stationary object as a result of for instance waves. The ship-based self stabilizing platform actively compensates for all vessel motions to provide safe offshore access to the stationary object in the water, such as a drill rig or production platform. An example of such a gangway 6 with a self stabilizing platform is known under the trade name "Ampelmann". For mounting and dismounting the ship in other embodiments other types of gangways can be used, also mounted on different locations on the ship 1.

In the design of the hull 4 an aft of the ship, that is the 60% to 70% of the length of the hull 4 when taken from the stern 5, has substantially flat bottom surfaces 15 that in cross sections are V-shaped and extend symmetrically upwards with a deadrise angle 17 that is less than 40 degrees and possibly less than 30 degrees to the horizontal and above the water the hull has substantially vertical sides 10. FIG. 2 shows this in the body plan of the hull 4 with a centre plane 22, whereby the left side of the diagram shows the cross sections of the hull 4 at the rear of amidships. In a foreship of the hull 4 the bottom surface 12 gradually gets a larger deadrise angle. In the embodiment of FIG. 1 the bow 3 is perpendicular to the water so that near the bow 3 the deadrise angle is almost 90 degrees.

The ship 1 is provided with a trim tank (see FIGS. 4 to 9) that may have two or more compartments. This trim tank has a large volume; the trim tank volume is such that the weight of a filled trim tank is more than 30% and might be more than 40% of the weight of displacement of the hull with an empty trim tank. This means that the draught of the hull 4 considerably increases with a filled trim tank. In FIG. 2 this is indicated with a first line 12 for a first draught of the hull 4 with the trim tank empty and a second line 11 for a second draught of the hull 4 with the trim tank filled. The bottom surfaces 15 extend to the sides 10 and the width of the sides 10 is such that the immersed width of the bottom surfaces 15 increases with an added width 20 at each side when the trim tank is filled and the draught changes from the first draught (first line 12) to the second draught (second line 11). The added width 20 at each side is at least 5% of the beam or width amidships, or might be at least 7.5%. The increased mass of the ship changes the centre of gravity G to a new position G', which might be above the original centre of gravity G. Further it changes the moment of inertia so that the natural frequency for rolling is lower.

The hull 4 has in the aft ship bilge keels 13 that are mounted perpendicular on the bottom surface 15 at the height of the first water level 12. The bilge keels 13 extend a bilge keel height 16 from the surface 15, the bilge keel height 16 is more than 0.50 m or more than 4% of the width or beam at water level, whichever is less. In the shown embodiment the bilge keels 13 extend on each side of the hull 4 over a length of approximately 60% of the length L, in other embodiments this might be shorter, with a minimum of 30% of the length L. In the shown embodiment, the bilge keels 13 have in the downwards directed angle between the bilge keel 13 and the bottom surface 15 a spray radius 14. In this way when sailing with an empty trim tank and at the first draught (first line 12) the bilge keel 13 acts as a spray rail.

When the trim tank is filled and the hull 4 is at the second draught (second line 11) the bilge keels 13 extend to a bilge keel draught 18 below the second draught (second line 11) and the bilge keel depth 18 is more than 0.50 m or more than 4% of the immersed width or beam, whichever is less. This bilge keel depth 18 ensures that the bilge keels 13 reduce the rolling of the ship in waves. With filled trim tank the bottom surface 15 extends with a free bottom surface 21 above the second draught (second line 11) and the side 10 starts at a height 19 above the water. This increased free bottom surface 21 and the height 19 change the position of the centre of buoyancy B. The changed position of the centre of buoyancy B changes the location of the metacentre M and with that the metacentric height GM or G'M. The change of the metacentric height GM, G'M changes the rolling frequency so that the design can be adapted to a lower rolling frequency which when the ship is at the second draught (second line 11) and the comfort of the passengers increases.

Figure 3:
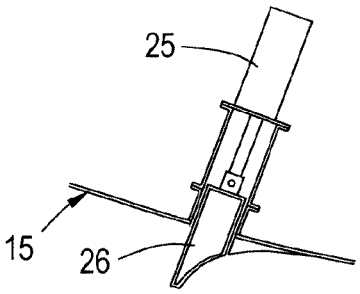
FIG. 3 shows a detail of a retractable bilge keel for the ship of FIG. 1, and FIGS. 4-9 show in the lines plan of the ship of FIG. 1 the various locations of a trim tank.

FIG. 3 shows a detailed cross section of a retractable bilge keel 26 that has a positioning drive 25. When the trim tank is empty and the hull 4 is at the first draught (first line 12) the positioning drive 25 retracts the bilge keel 26 and on the bottom surface 15 a small spray ridge might remain. This reduces the flow resistance when moving at high speed. With filled trim tank and at the second draught (second line 11) the bilge keel 26 extends from the bottom surface 15 and reduces the rolling of the ship 1. It will be clear that in different embodiments of the ship 1 the bilge keels can have different shapes that might be a combination of the earlier described embodiments.

Figure 4:
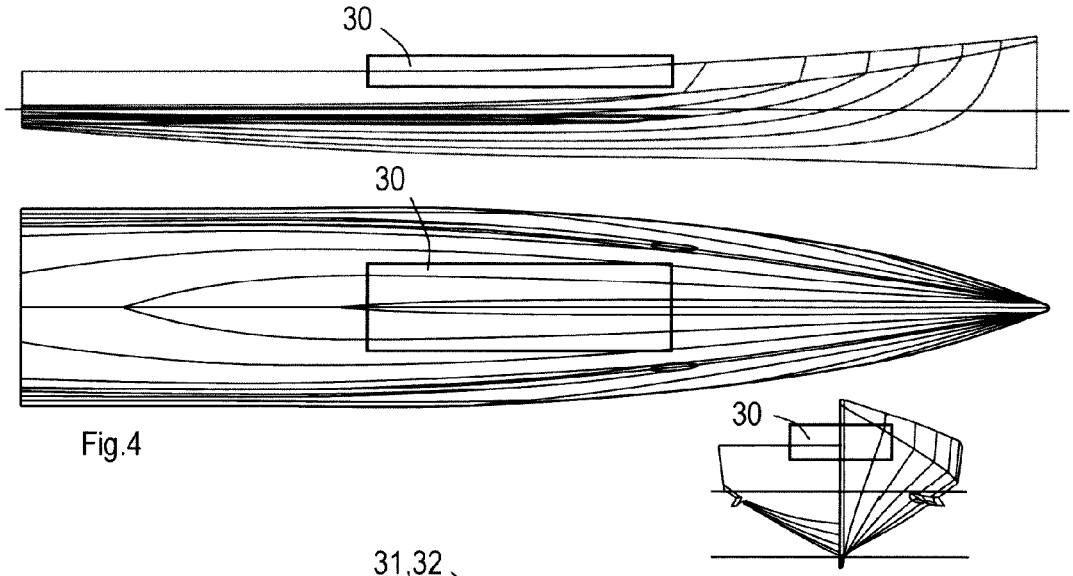
Figure 5:
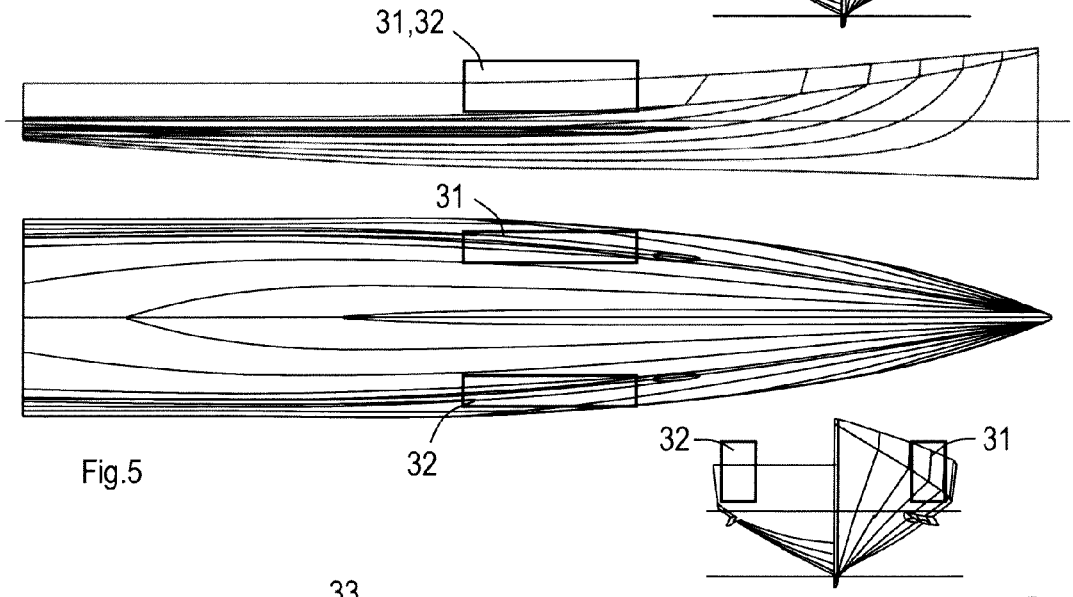
Figure 6:
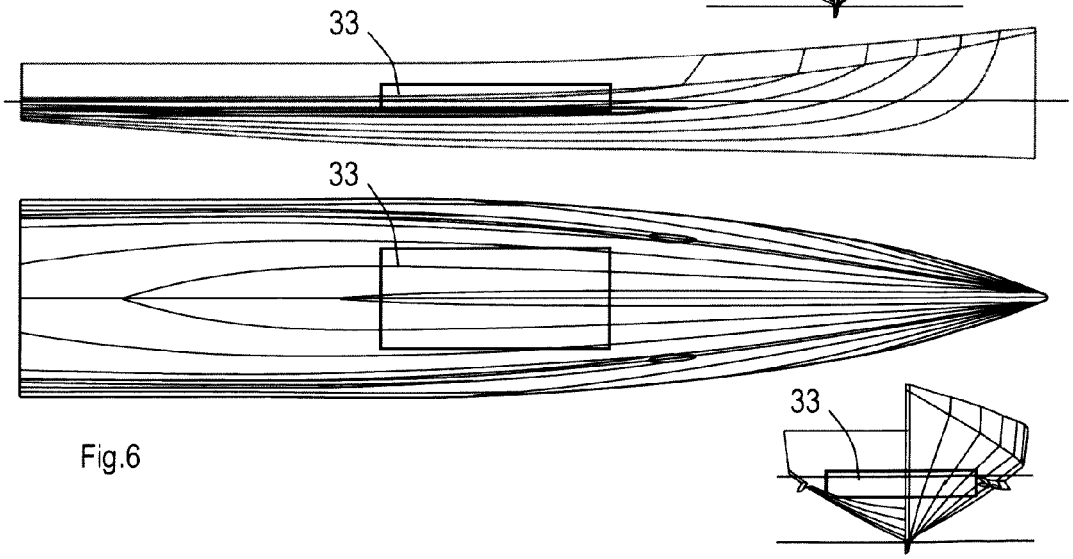
Figure 7:
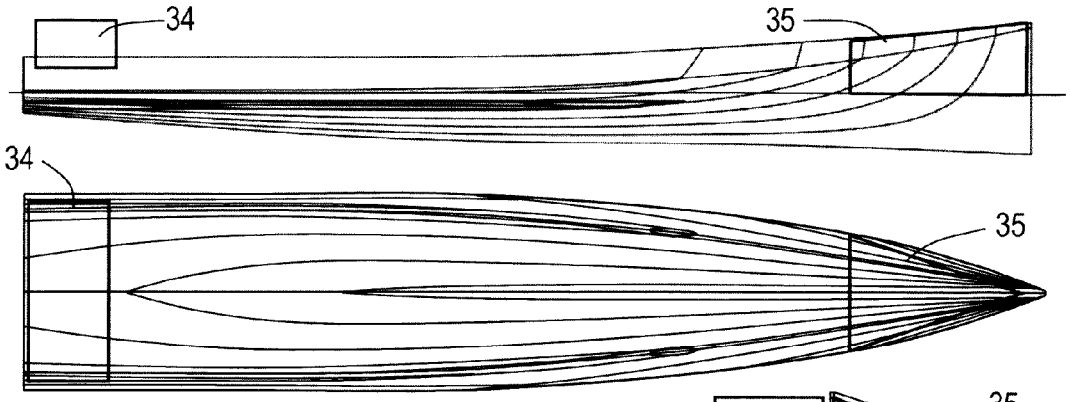
Figure 7:
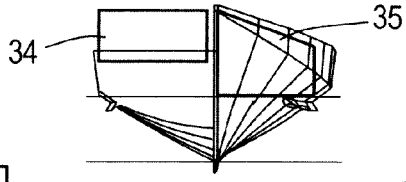
Figure 8:
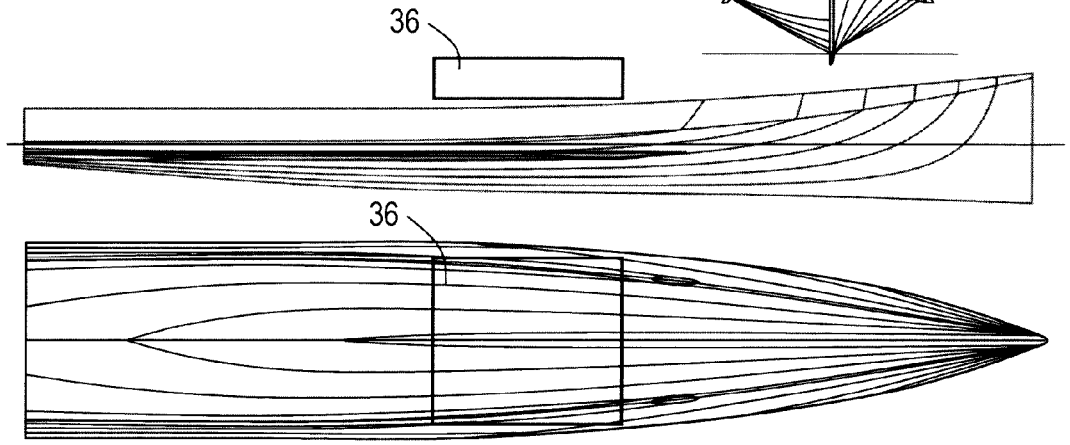
Figure 8:
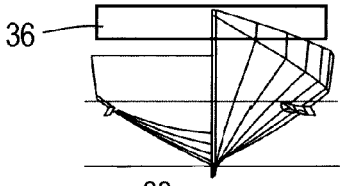
Figure 9:
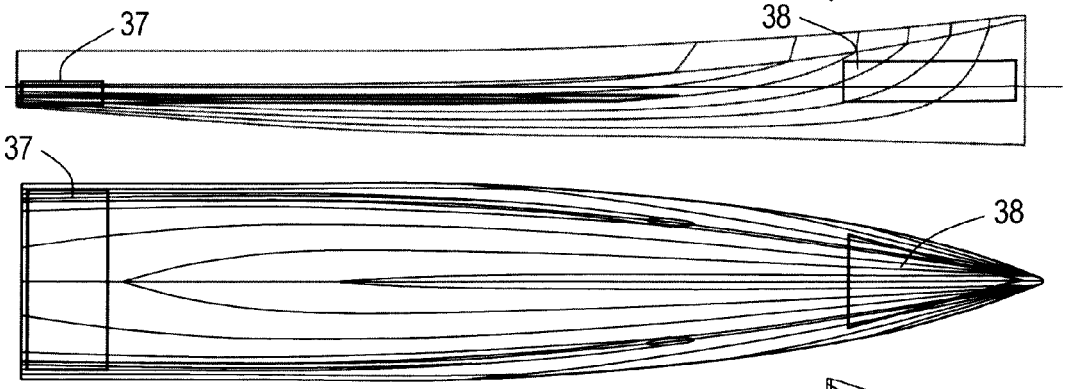
Figure 9:
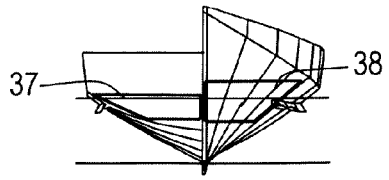

FIGS. 4, 6 and 8 show a trim tank with one compartment in the lines plan of the ship 1; FIGS. 5, 7 and 9 show a trim tank with two compartments. It will be clear that the trim tank might have more compartments and that the positions of the trim tank (compartments) in the figures are indicative only.

FIG. 4 shows an embodiment of ship 1 with a trim tank 30 at deck level which is above the centre of gravity G. Filling the trim tank 30 will lead to a small increase in the height of the centre of gravity and to a small increase in the moment of inertia in roll direction.

FIG. 5 shows an embodiment of ship 1 with a trim tank 31 and a trim tank 32 at deck level on port and starboard respectively. Filling the trim tanks 31, 32 will lead to a small increase in the height of the centre of gravity and to a considerable increase of the moment of inertia in roll direction.

FIG. 6 shows an embodiment of ship 1 with a trim tank 33 at water line level which is near the level of the centre of gravity G. Filling the trim tank 33 will hardly lead to a change in the height of the centre of gravity and to a small increase in the moment of inertia in roll direction.

FIG. 7 shows an embodiment of ship 1 with a trim tank 34 and a trim tank 35 at deck level which is above the centre of gravity G whereby the trim tank 34 is near the stern 5 and trim tank 35 is near the bow 3. Filling the trim tank 34, 35 will lead to a small increase in the height of the centre of gravity and to an increase in the moment of inertia in pitch direction.

FIG. 8 shows an embodiment of ship 1 with a trim tank 36 high above deck level which is above the centre of gravity G. Filling the trim tank 36 will lead to an increase in the height of the centre of gravity and to an increase in the moment of inertia in roll direction.

FIG. 9 shows an embodiment of ship 1 with a trim tank 37 and a trim tank 38 at waterline level which is at the level of the centre of gravity G. Filling the trim tanks 37, 38 will not lead to a change in the height of the centre of gravity, to little change in the moment of inertia in roll direction and to a considerable change in the moment of inertia in the pitch direction.

It is noted that in practice it might be advantageous to perform the intake and outlet of water into and from the trim tank on substantially the same position or within substantially the same area. As a result, the spreading of, e.g., micro-organisms is prevented or at least reduced.

The various embodiments of the positions of the trim tanks 30-38 might be combined so that during use in dependence of the sea conditions the behavior of the ship 1 in waves can be altered.

The invention claimed is:

1. A ship comprising a hull with a waterline length and a mechanical propulsion device for generating a maximum speed, whereby the hull and the propulsion device are designed such that the Froude number ($v/\sqrt{g*L}$) is larger than 0.5, the hull has a foreship with a bow and an aft ship with a stern, in the aft ship the hull has a bottom with V-shaped bottom surfaces that in the immersed part of the hull extend symmetrically upwards with a deadrise angle that is less than 40 degrees and above the water level the hull has substantially vertical sides, in the hull are a passenger compartment and a trim tank with a trim tank volume characterized in that the trim tank volume is such that the weight of a filled trim tank is more than 30% of the weight of displacement of the hull with an empty trim tank, that the hull is designed such that filling the trim tank with water increases the amidships immersed width or beam of the hull when stationary in the water with at least 10%, and that in the aft ship the bottom surfaces have bilge keels located such that the bilge keels are fully immersed when the trim tank is filled with water and the bilge keels are at least in part above the water level when the trim tank is empty.

2. The ship in accordance with claim 1 wherein the bilge keels are retractable.

3. The ship in accordance with claim 1 wherein when the trim tank is filled with water the bilge keels extend to a draught of more than 0.50 m or more than 4% of the immersed width or beam, whichever is less.

4. The ship in accordance with claim 1, wherein the bilge keels extend perpendicular to the bottom surfaces with a bilge keel height of more than 0.50 m or more than 4% of the width or beam at water level, whichever is less.

5. The ship in accordance with claim 1 wherein in the downwards directed angle between the bilge keel and the bottom surface there is a rounded transition with a radius that is at least 50% of the bilge keel height and wherein the bilge keels are located such that with an empty trim tank and with a forward moving ship the bottom surfaces and the bilge keels create a downwards directed spray.

6. The ship in accordance with claim 1 wherein the bilge keels extend on each side of the hull over a length of more than 30% of the overall length.

7. The ship in accordance with claim 1 wherein the bilge keels extend on each side of the hull over a length of approximately 60% of the overall length.

8. The ship in accordance with claim 6, wherein the bilge keels extend from the aft ship towards the foreship.

9. The ship in accordance with claim 1 wherein the trim tank comprises one or more compartments that is located amidships above the center of gravity of the hull or amidships at the sides of the ship.

10. The ship in accordance with claim 1 wherein the trim tank comprises two compartments and one trim tank compartment is located in the foreship near the bow and one trim tank compartment is located near the stern.

11. The ship in accordance with claim 1 wherein the trim tank is located at approximately the water level.

12. The ship in accordance with claim 1 wherein the passenger compartment is near the center of gravity of the hull and the passenger compartment is acoustically isolated.

13. The ship in accordance with claim 12 wherein the passenger compartment comprises passenger seats that have backrests that are reclinable to a substantially horizontal position.

14. The ship in accordance with claim 12 wherein the passenger compartment includes a visual display.

15. The ship in accordance with claim 1 wherein the trim tank is located above main deck level.

16. The ship according to claim 12 wherein said passenger compartment has an air conditioning system.

* * * * *